United States Patent [19]

Stephens, III

[11] 4,366,368

[45] Dec. 28, 1982

[54] ELECTRIC HEATER-BLOWER APPARATUS FOR REMOVING FROST AND SNOW FROM VEHICLE WINDOWS

[76] Inventor: William S. Stephens, III, 143 Spoonhour Dr., Casselberry, Fla. 32707

[21] Appl. No.: 101,008

[22] Filed: Dec. 6, 1979

[51] Int. Cl.[3] ..... F24H 3/04

[52] U.S. Cl. ..... 219/367; 15/405; 15/416; 34/97; 34/243 C; 132/9; 219/203; 219/370; 219/373; 239/446; 239/562

[58] Field of Search ..... 219/366–370, 219/373, 202, 203, 364; 98/40 V; 239/436, 446, 447, 562; 34/96–101, 243; 15/328, 400, 405, 416; 132/9

[56] References Cited

U.S. PATENT DOCUMENTS

| | | | |
|---|---|---|---|
| 1,168,219 | 1/1916 | Miller | 239/436 |
| 1,622,803 | 3/1927 | Noonan | 219/364 |
| 1,751,841 | 3/1930 | Pickens | 219/367 X |
| 1,838,438 | 12/1931 | Nichols | 239/446 |
| 1,918,927 | 7/1933 | Otto | 239/562 X |
| 2,148,726 | 2/1939 | Brandt | 239/447 |
| 2,509,137 | 5/1950 | Denman | 219/370 X |
| 2,606,273 | 8/1952 | Franklin | 219/364 X |
| 2,827,060 | 3/1958 | Marty | 132/9 |
| 3,209,127 | 9/1965 | Graves | 219/370 |
| 3,211,890 | 12/1965 | Graves | 219/370 |
| 3,313,915 | 4/1967 | Chamberlain | 219/203 X |
| 3,947,659 | 3/1976 | Ono | 219/370 X |
| 4,198,557 | 4/1980 | Crowley | 219/367 |

*Primary Examiner*—A. Bartis

*Attorney, Agent, or Firm*—Harvey B. Jacobson

[57] ABSTRACT

A portable frost and snow removing appliance for use in removing ice and snow from the surfaces of vehicle windows includes an elongated housing having a pistol handgrip at one end and containing an electrically operated two-speed blower and a resistance heater arranged to produce a high speed jet of unheated air or a slower stream of heated air through a discharge nozzle shiftably mounted on the other end of the housing and movable between first and second positions. The housing includes a lateral air outlet in a side wall between the heater and nozzle. The nozzle includes as a unitary one-piece structure therewith valve members within the housing and nozzle and cooperatively associated with the housing other end and the lateral air outlet to inversely open and close the lateral outlet and housing other end in response to shifting of the nozzle to its first and second positions, respectively, to permit air to be selectively discharged from either the nozzle or lateral air outlet. The housing is capable of being placed on its side upon the upper surface of a vehicle dash and operated in a manner to discharge heated air through the lateral air outlet upwardly along the inner windshield surface.

11 Claims, 8 Drawing Figures

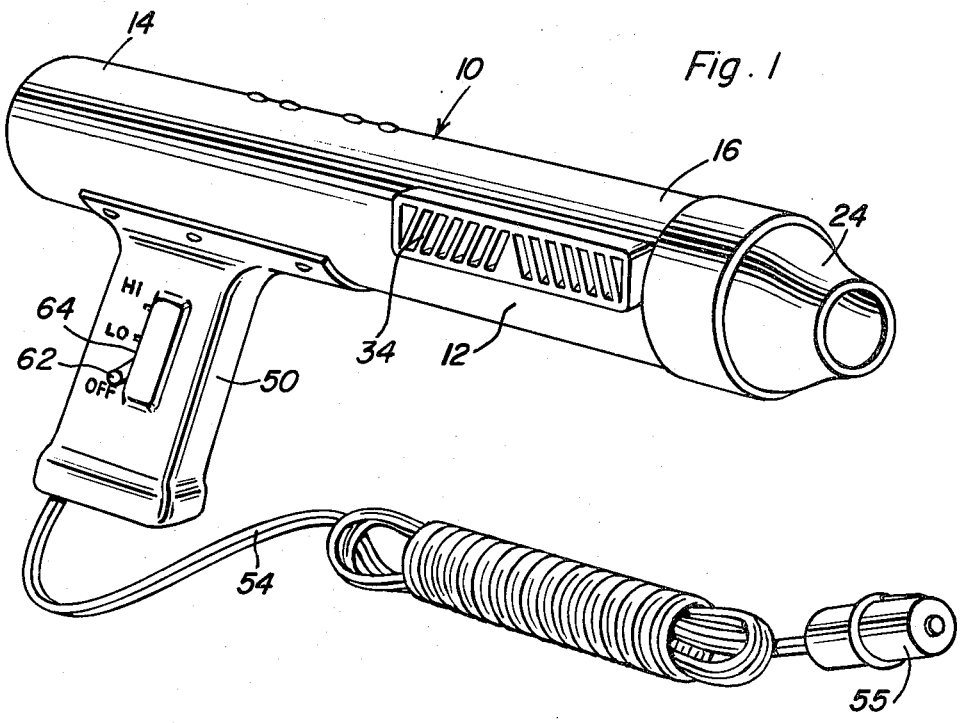
Fig. 1
Fig. 2
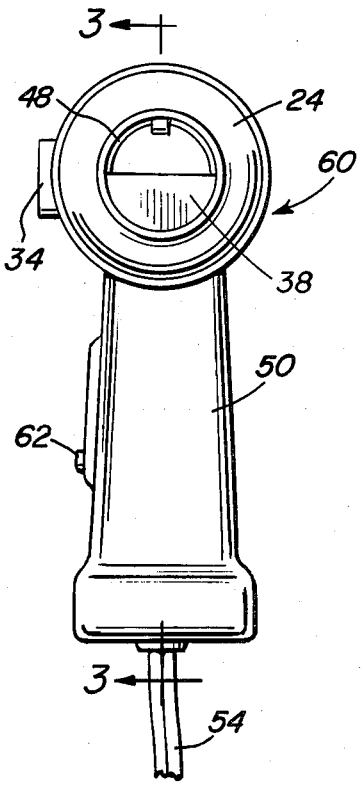
Fig. 6
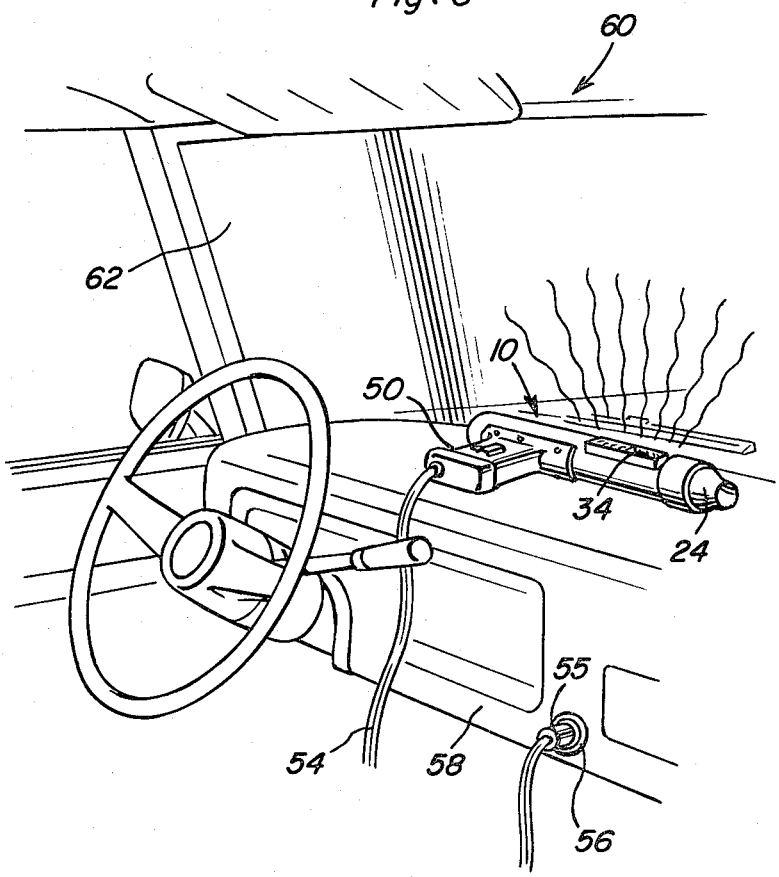

TWO-SPEED MOTOR
ELECTRIC HEATER
TWO-SPEED MOTOR
HI
LO

ELECTRIC HEATER-BLOWER APPARATUS FOR REMOVING FROST AND SNOW FROM VEHICLE WINDOWS

BACKGROUND OF THE INVENTION

Various forms of electrical resistance heated blower structures previously have been provided for use in removing snow and ice from the exterior and interior surfaces of vehicle windshields. Most of these structures are conventionally provided with plugs which may be plugged into a conventional cigarette lighter receptacle in lieu of the conventional cigarette lighter element in order to provide a suitable source of electrical potential from the associated vehicle's electrical system to actuate the blower and heater structure.

Examples of previously known forms of heating and blower structures of this type are disclosed in U.S. Pat. Nos. 2,121,753, 3,209,127, 3,331,940, 3,492,462, 3,610,881, 3,612,824 and 3,668,370.

However, these previously known forms of electrically actuated heaters and blowers are for various reasons not as effective as they might be for removing snow and ice from both the external and internal surfaces of a vehicle windshield. Accordingly, a need exists for an improved form of snow and ice removing blower which may be electrically actuated from a vehicle's electrical system and utilized effectively to remove both snow and ice from the exterior and interior surfaces of the windshield of the vehicle.

BRIEF DESCRIPTION OF THE INVENTION

The frost (ice) and snow remover of the instant invention has been specifically designed to enable vehicles whose windshields have snow and/or ice and frost on the outer and inner surfaces thereof to be operated in the shortest possible time and to thereby eliminate the necessity of having to "warm up" a vehicle engine in cold weather for five to ten minutes before the vehicle's defrosting system can generate sufficient heat to remove snow and ice from the windshield. The recent shortage of vehicle fuel in this country has stressed the importance of not wasting fuel during long periods of initial warm up. Further, although in the past it was thought that a vehicle engine should be completely "warmed up" before attempting to drive the vehicle in cold weather in order to reduce engine wear, it has recently become known that less engine wear occurs if a vehicle is allowed to idle for only fifteen or thirty seconds sufficient to insure adequate lubrication and then initially driven at moderate speeds until "warm up" of the engine is accomplished.

It is accordingly the main object of this invention to provide an electric frost (ice) and snow remover for use on a vehicle to remove snow and ice or frost from the exterior and interior windshield surfaces in the shortest possible time.

Another object of this invention is to provide a frost and snow remover in the form of a pistol-type grip blower for initially blowing loose snow from the exterior windshield surfaces and constructed in a manner whereby it may be placed on its side upon the upper surface of a vehicle dash and operated in a manner to discharge heated air upwardly along the inner windshield surface.

Yet another object of this invention is to provide a frost and snow remover in accordance with the preceding objects and including an extension cord therefor equipped with a plug for reception in a vehicle cigarette lighter socket.

Another important object of this invention is to provide a frost and snow remover which may be readily actuated to discharge either a high speed jet of unheated air or a slower speed flow of heated air.

A final object of this invention to be specifically enumerated herein is to provide an electric frost and snow remover in accordance with the preceding objects and which will conform to conventional forms of manufacture, be of simple construction and easy to use so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 1 is a perspective view of the electric frost and snow remover of the instant invention;

FIG. 2 is a front elevational view of the apparatus illustrated in FIG. 1;

FIG. 6 is a fragmentary perspective view illustrating the manner in which the apparatus illustrated in FIG. 1 may be placed upon the upper surface of a vehicle dashboard and utilized to direct a fan-shaped discharge of heated air upwardly along the inner surface of the vehicle windshield;

DETAILED DESCRIPTION OF THE INVENTION

Figures 3, 4, 5, 7, 8:
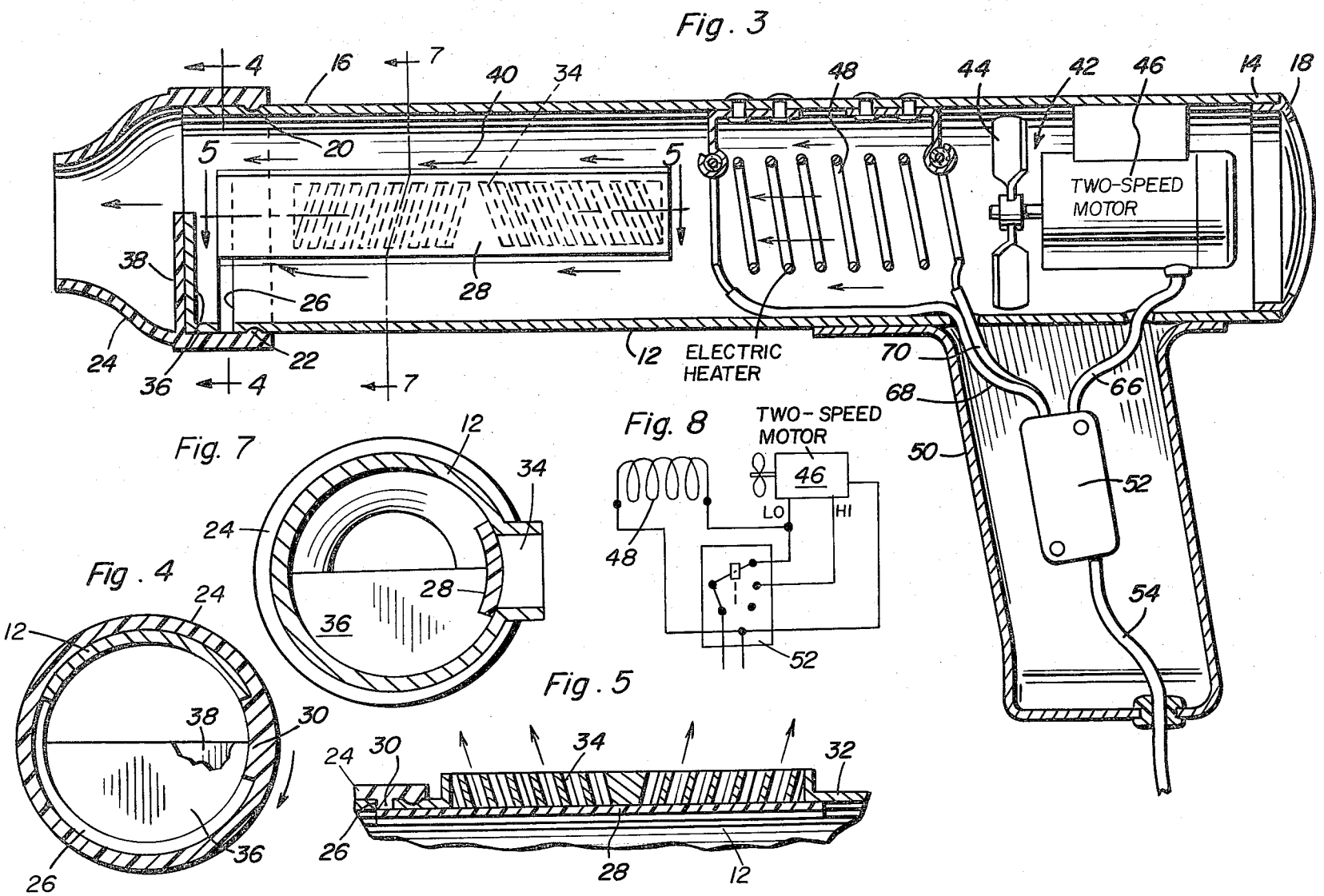
FIG. 3 is an enlarged longitudinal vertical sectional view taken substantially upon the plane indicated by the section line 3—3 of FIG. 2.
FIG. 4 is a transverse sectional view taken substantially upon the plane indicated by the section line 4—4 of FIG. 3.
FIG. 5 is a fragmentary horizontal sectional view taken substantially upon the plane indicated by the section line 5—5 of FIG. 3.
FIG. 7 is a transverse sectional view taken substantially upon the plane indicated by the section line 7—7 of FIG. 3; and, FIG. 8 is a diagrammatic view of the wiring circuit of the frost and snow remover.

Referring now more specifically to the drawings, the numeral 10 generally designates the electric frost and snow remover of the instant invention. The remover 10 includes an elongated cylindrical housing 12 having first and second inlet and outlet ends 14 and 16. The inlet end 14 includes a grill-type closure 18 thereover defining an air inlet and the outlet end 16 includes a circumferential outwardly opening groove 20 in which a circumferentially extending and inwardly projecting rib 22 of a nozzle 24 is slidingly received to rotatably mount the nozzle 24 on the outlet end 16.

The outlet end 16 also includes a circumferential slot 26 of somewhat more than 180° angular extend formed therein and an elongated transversely arcuate closure panel 28 is disposed within the housing 12 and is connected to the nozzle 24 by a tongue portion 30 slidingly received in and extending through the slot 26.

One longitudinal side wall 32 of the housing 12 includes a elongated louvered outlet 34 and the cover panel 28 is movable into and out of registry with the inner extremity of the outlet 34 upon rotation of the nozzle 24 relative to the housing 12. In addition, the outlet end 16 of the housing 12 includes a slightly greater than one-half circular end wall 36 and the nozzle 24 includes a slightly greater than one-half circular end wall 38. The end walls 36 and 38 are disposed in superposed registry with each other in the position of the nozzle illustrated in FIG. 3 whereby air passing through the housing 12 to the left in the direction of the arrows 40 may pass over both the end walls 36 and 38 and be discharged from the nozzle 24. However, when the nozzle 24 is rotated approximately 180° from the position thereof illustrated in FIG. 3, the walls 36 and 38 coact to form a full end wall to completely block the inlet end of the nozzle 24. When the nozzle 24 is in the position thereof illustrated in FIG. 3, the cover panel 28 is in closing registry with the lateral outlet 34. However, when the nozzle 24 is rotated approximately 180° from the position thereof illustrated in FIG. 3 in order to close the nozzle 24, the cover panel 28 is moved out of closing registry with the lateral outlet 34 and air may be exhausted from the interior of the housing 12 through the lateral outlet 34.

A blower assembly referred in general by the reference numeral 42 is disposed within the inlet end 14 of the housing and includes an axial flow fan 44 driven by a two-speed electric motor 46. Further, an electrical resistance heating element 48 is mounted within the housing 12 intermediate the axial flow fan 44 and the lateral outlet 34 and the housing 12 includes a laterally outwardly projecting pistol-type hand grip 50 within which a three-way switch 52 is mounted. An extension cord 54 is electrically connected to the switch 52 at one end and includes a male plug 55 at its other end for reception in the cigarette lighter receptacle or socket 56 on the dashboard 58 of the vehicle referred to in general by the reference numeral 60 in FIG. 6. The switch includes a three-position actuator 62 which projects through a slot 64 provided therefor in one side of the hand grip 50 and the switch 52, extension cord 54 and plug 55 and receptacle 56 may be of any well known conventional design. The switch 52 is electrically connected to the motor 46 by a conductor cord 66 and to the electrical resistance heating element 48 by electrical conductors 68 and 70. In one position of the actuator 62, electrical connection between the motor 46 and the extension cord 54 and between the heating element 48 and the extension cord 54 is interrupted. In the second position of the actuator 62, the extension cord is electrically connected to both the electrical resistance heating element 48 and the slow speed windings of the motor 46. In the third position of the actuator 62, the switch 52 electrically connects the extension cord 54 to the high speed windings, only, of the electric motor 46.

In operation, the motor 46 may be operated at high speed with the nozzle open in order to blow light snow from the exterior windshield and window surfaces of an associated vehicle after the engine of the vehicle has been initially started and as soon as the snow has been blown from the exterior windshield and window surfaces, the housing 12 may be placed on its side on the upper surface of the dashboard 58 in the manner illustrated in FIG. 2 of the drawings and the switch actuator may be shifted to the second position thereof whereby the motor 46 will be operated at slow speed and the electrical heating element 48 will be electrically actuated. Further, when the housing 12 is to be used in the manner illustrated in FIG. 6, the nozzle 24 is rotated approximately 180° from the position thereof illustrated in FIG. 3 in order to close the nozzle 24 and open the lateral outlet 34 whereby a fan-shaped discharge of heated air will directed upwardly along the inner surfaces of the windshield 62 of the vehicle.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A frost and snow remover including an elongated portable hollow housing having first and second ends, said first end including an end outlet for air pumped through said housing and said second end including an inlet for the entrance of air into said housing, electrically actuated air pump means in said housing for pumping air therethrough from said second end to said first end, electrical resistance heating means in said housing downstream from said air pump means for heating air being pumped through said housing, said housing including an elongated lateral outlet formed in one longitudinal wall portion thereof spaced between said heating means and said outlet and opening laterally outwardly of said one housing wall portion, an outlet nozzle communicating with said end air outlet shiftably support on said first end of said housing for movement between first and second positions and including a cover panel coextensive in size with said elongated air outlet mounted within said housing for shifting relative thereto with said nozzle, said nozzle and housing including coacting portions operative to open and close said first end outlet responsive to shifting of said nozzle to said first and second positions, respectively, said cover panel, nozzle and coacting portion of said nozzle comprising a unitary one-piece structure, and said cover panel, when said nozzle is shifted to said first position being automatically shifted into closing registry with said elongated air outlet and, when said nozzle is shifted to said second position, being automatically shifted out of registry with said elongated air outlet to open said elongated air outlet, and circuit means for electrically connecting said air pump means and heating means with a source of electrical potential.

2. The combination of claim 1 wherein said electrically actuated air pump means includes a two-speed (low and high) motor, and said circuit means includes means operative to selectively actuate said motor at low speed together with said heating means and to operate said motor at high speed independent of actuation of said heating means.

3. The combination of claim 1 wherein said housing includes an elongated laterally outwardly projecting and relatively inclined pistol-type hand grip.

4. The combination of claim 3 wherein said housing is of such size and shape as to be capable of being laid on the dashboard of a motor vehicle with said one longitudinal wall of said housing facing upwardly, and said circuit means includes extension cord means having a plug receivable in a vehicle cigarette lighter socket, whereby the frost and snow remover can be laid upon a vehicle dashboard with the elongated lateral outlet facing the interior of the vehicle windshield.

5. The combination of claim 1 wherein said circuit means includes an extension cord having a male plug on one end for reception within and an electrical connection with a conventional cigarette lighter socket.

6. The combination of claim 1 wherein said elongated lateral outlet includes louvers for directing a fan-shaped discharge of air therefrom.

7. The combination of claim 6 wherein said housing includes an elongated laterally outwardly projecting and relatively inclined pistol-type hand grip.

8. The combination of claim 6 wherein said circuit means includes an extension cord having a male plug on one end for reception within and an electrical connection with a conventional cigarette lighter socket.

9. The combination of claim 1 wherein said first end of said housing is generally cylindrical and said nozzle includes a generally cylindrical base portion telescoped over and rotatably mounted on said first end of said housing.

10. A frost and snow remover including an elongated portable hollow housing having first and second ends, said housing including hand grip defining means on said second end for hand support of said housing in one hand of the user, said housing being of a size and weight to be readily hand supported, said first end including an end outlet for air pumped through said housing and said second end including an inlet for the entrance of air into said housing, electrically actuated air pump means in said housing for pumping air therethrough from said second end to said first end, electrical resistance heating means in said housing downstream from said air pump means for heating air being pumped through said housing, said housing including an elongated lateral outlet formed in one longitudinal side wall portion thereof spaced between said heating means and said outlet and opening laterally outwardly of said one housing wall portion, an outlet nozzle communicating with said end air outlet shiftably supported on said first end of said housing for movement between first and second positions and including as a unitary one-piece structure therewith valve members within said housing and nozzle cooperatively associated with said end outlet and said lateral outlet for inversely opening and closing said end and lateral outlets in response to shifting of said nozzle to said first and second positions, respectively, and circuit means for electrically connecting said air pump means and heating means with a source of electrical potential, said housing including said handgrip being of greater length than width and of greater width than thickness, whereby said housing may be positioned with its other longitudinal side wall portion facing downwardly and supported from the upper surface of a vehicle dashboard and said one longitudinal side wall portion and said lateral outlet facing and opening upwardly toward the rearwardly and upwardly inclined inner surface of a vehicle windshield disposed thereabove.

11. The combination of claim 10 wherein said electrically actuated air pump means includes a two-speed (low and high) motor, said circuit means including means operative to selectively actuate said motor at low speed together with said heating means and to operate said motor at high speed independent of actuation of said heating means.

* * * * *